US009908233B2

(12) United States Patent
Wilcox

(10) Patent No.: US 9,908,233 B2
(45) Date of Patent: Mar. 6, 2018

(54) FASTENER INSTALLATION TOOL

(71) Applicant: ALCOA INC., Pittsburgh, PA (US)

(72) Inventor: Robert Wilcox, Port Ewen, NY (US)

(73) Assignee: ARCONIC INC., Pittsburgh, PA (US)

( * ) Notice: Subject to any disclaimer, the term of this patent is extended or adjusted under 35 U.S.C. 154(b) by 662 days.

(21) Appl. No.: 14/324,346

(22) Filed: Jul. 7, 2014

(65) Prior Publication Data

US 2015/0014014 A1 Jan. 15, 2015

Related U.S. Application Data

(60) Provisional application No. 61/844,120, filed on Jul. 9, 2013.

(51) Int. Cl.
*B25F 5/00* (2006.01)
*B25B 21/00* (2006.01)
(Continued)

(52) U.S. Cl.
CPC ..... *B25F 5/005* (2013.01); *B21J 15/105* (2013.01); *B21J 15/22* (2013.01); *B25B 21/00* (2013.01)

(58) Field of Classification Search
CPC ... B25C 1/047; B25C 1/188; B25D 2250/231; B25F 5/005; B25F 5/021; B21J 15/105; B21J 15/22; B25B 21/00
(Continued)

(56) References Cited

U.S. PATENT DOCUMENTS 2,526,956 A * 10/1950 Kugler ..... B21J 15/105 30/228
3,039,270 A * 6/1962 Simmons ..... B21J 15/022 227/10
(Continued)

FOREIGN PATENT DOCUMENTS

CN 2115847 U 9/1992
CN 1175916 A 3/1998
(Continued)

OTHER PUBLICATIONS

International Search Report and Written Opinion dated Jan. 22, 2015, issued by the European Patent Office in International (PCT) Application No. PCT/US2014/045536 (10 pages).
(Continued)

*Primary Examiner* — Hemant M Desai
*Assistant Examiner* — Lucas Palmer
(74) *Attorney, Agent, or Firm* — Greenberg Traurig, LLP

(57) ABSTRACT

A fastener installation tool including a cylinder assembly, a handle/sleeve assembly, and a tool head. The handle/sleeve assembly includes a handle having a bore and a sleeve positioned within the bore. An inner wall of the sleeve includes a first portion with a first inner diameter and a second portion with a second inner diameter. The sleeve includes an outer wall having a first portion with a first outer diameter and a second portion with a second outer diameter, the first outer diameter of the first portion of the outer wall of the sleeve being greater than the second outer diameter of the second portion of the outer wall of the sleeve. A space is formed between the second portion of the outer wall of the sleeve and the second portion of the inner wall of the handle, which enables the sleeve to flex during operation of the tool.

11 Claims, 4 Drawing Sheets

(51) Int. Cl.
*B21J 15/10* (2006.01)
*B21J 15/22* (2006.01)

(58) Field of Classification Search
USPC ..... 173/218, 81–115, 165, 171
See application file for complete search history.

(56) References Cited

U.S. PATENT DOCUMENTS 3,550,484 A * 12/1970 Pecoraro ..... B25B 21/00 81/125
3,646,757 A * 3/1972 Sanders ..... F15B 11/072 227/130
3,713,321 A 1/1973 LaPointe
3,991,601 A * 11/1976 Duncan ..... B21J 15/022 29/243.522
4,118,969 A * 10/1978 Corbett ..... B21J 15/022 29/243.525
4,454,746 A 6/1984 Schwab
4,515,005 A * 5/1985 Klein ..... B21J 15/105 29/243.525
4,517,820 A * 5/1985 Oefinger ..... B21J 15/105 29/243.525
4,580,435 A 4/1986 Port et al.
4,597,263 A 7/1986 Corbett
4,598,571 A * 7/1986 Oefinger ..... B21J 15/105 29/243.525
4,615,206 A 10/1986 Rosier
4,796,455 A 1/1989 Rosier
4,813,261 A * 3/1989 Rosier ..... B21J 15/022 29/243.522
4,878,372 A 11/1989 Port et al.
5,231,902 A * 8/1993 Uno ..... B25B 23/045 173/159
5,371,933 A 12/1994 Godfrey
5,485,727 A * 1/1996 Godfrey ..... B21J 15/105 29/243.523
5,519,926 A * 5/1996 Rosier ..... B21J 15/022 29/243.523
5,697,137 A * 12/1997 Frearson ..... B21J 15/043 29/243.521
5,806,160 A * 9/1998 Frearson ..... B21J 15/043 29/243.523
6,532,635 B1 * 3/2003 Gregory ..... B21J 15/043 29/243.523
6,739,170 B1 5/2004 Rosier
7,458,245 B1 12/2008 Wilcox
7,631,534 B2 12/2009 Wilcox
8,365,375 B2 * 2/2013 Lin ..... B21J 15/043 29/243.523
9,370,820 B2 * 6/2016 Seewraj ..... B21J 15/22
2006/0150402 A1 * 7/2006 Lin ..... B21J 15/043 29/812.5
2006/0179631 A1 * 8/2006 Lin ..... B21J 15/043 29/243.521
2012/0090142 A1 * 4/2012 Lin ..... B21J 15/043 29/243.523
2013/0199813 A1 * 8/2013 Zimmerman ..... E02D 7/10 173/200

FOREIGN PATENT DOCUMENTS

CN 1590033 A 3/2005
CN 101903120 A 12/2010
EP 0 154 280 A2 9/1985
GB 2372475 A 8/2002

OTHER PUBLICATIONS

"Huck Lockbolts, Structural Blind Rivets and Tooling Catalog", Alcoa Fastening Systems, pp. 1-52 (2014).

* cited by examiner

FASTENER INSTALLATION TOOL

CROSS-REFERENCE TO RELATED APPLICATION

This application is a Section 111(a) application relating to and claiming the benefit of commonly owned, U.S. Provisional Patent Application Ser. No. 61/844,120 entitled "FASTENER INSTALLATION TOOL," filed Jul. 9, 2013, the entirety of which is incorporated herein by reference.

FIELD OF THE INVENTION

The present invention relates to installation tools and, more particularly, to fastener installation tools, including, but not limited to, pneudraulic fastener installation tools.

BACKGROUND OF THE INVENTION

Fastener installation tools, such as pneudraulic fastener installation tools, are utilized to install fasteners to secure a plurality of workpieces to one another. The fasteners may be conventional pull-type fasteners which include a separable pintail portion engageable by a jaw assembly attached to the tool. It is always desirable to extend the tool's life, prevent leakage of hydraulic fluid from the tool, and decrease manufacturing costs for the tool.

SUMMARY OF THE INVENTION

In an embodiment, a fastener installation tool including a cylinder assembly including a housing having an upper end, a lower end opposite the upper end; a handle/sleeve assembly including a handle attached to the upper end of the cylinder assembly, the handle having a first end, a second end opposite the first end, a bore extending between the first and second ends, and an inner wall defined by the bore, the inner wall having a first portion with a first inner diameter, a second portion with a second inner diameter, and a shoulder intermediate the first and second portions, the first inner diameter of the first portion being greater than the second inner diameter of the second portion, the handle/sleeve assembly further including a sleeve having a first end, a second end opposite the first end of the sleeve, an outer wall having a first portion with a first outer diameter and a second portion with a second outer diameter, and an annular step formed intermediate the first and second portions of the outer wall of the sleeve, the first portion of the sleeve extending from the first end of the sleeve to the annular step and the second portion of the sleeve extending from the annular step to the second end of the sleeve, the first outer diameter of the first portion of the outer wall of the sleeve being greater than the second outer diameter of the second portion of the outer wall of the sleeve, wherein the sleeve is positioned within the bore of the handle such that the annular step of the sleeve engages the shoulder of the inner wall of the handle, and the first portion of the outer wall of the sleeve is juxtaposed with the first portion of the inner wall of the handle, while the second portion of the outer wall of the sleeve is juxtaposed with the second portion of the inner wall of the handle. In an embodiment, a tool head is attached to the first end of the handle.

In an embodiment, a space is formed between the second portion of the outer wall of the sleeve and the second portion of the inner wall of the handle from below the shoulder of the inner wall of the handle and the annular step of the outer wall of the sleeve and extending to the second end of the sleeve. In an embodiment, the space is adapted to receive a volume of hydraulic fluid. In an embodiment, the annular step is formed angularly relative to the outer wall. In an embodiment, the annular step is angled obliquely relative to the outer wall. In an embodiment, the fastener installation tool includes an O-ring fitted around the outer wall of the sleeve, and the inner wall of the first portion of the handle includes an annular groove that is sized and shaped to house the O-ring. In an embodiment, the O-ring fits around the outer wall of the sleeve at a location proximate to a first end thereof. In an embodiment, the sleeve is adapted to flex laterally within the bore of the handle during operation of the fastener installation tool. In an embodiment, the sleeve is adapted to flex laterally in any direction relative to a circumference of the bore of the handle. In an embodiment, the cylinder assembly includes a piston having a piston head and a piston rod extending from the piston head, wherein the piston rod is received slidably within the sleeve. In an embodiment, the sleeve includes an inner wall having an inner diameter that is constant throughout the first and second portions of the sleeve. In an embodiment, the tool head includes a pull piston and a nose assembly having a collet and an anvil.

DETAILED DESCRIPTION OF THE DRAWINGS

Figure 1:
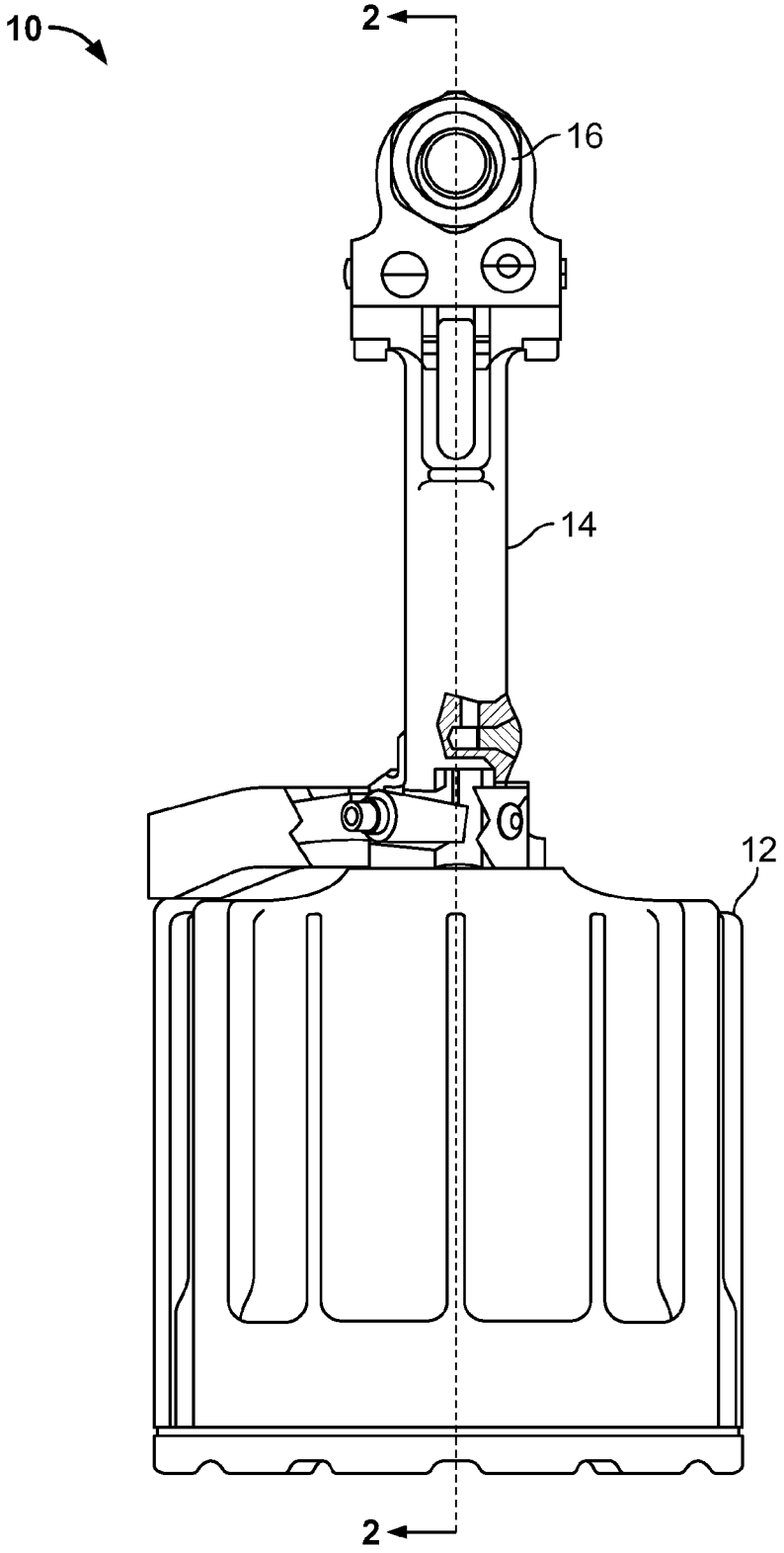
FIG. 1 is a front elevational view of an embodiment of a fastener installation tool.

Referring to FIG. 1, in an embodiment, a fastener installation tool 10 includes a cylinder assembly 12, a handle/sleeve assembly 14 secured to one end of the cylinder assembly 12, and a hydraulically actuated driving tool head 16 attached to an end of the handle/sleeve assembly 14. In various embodiments, the fastener installation tool 10 may be similar in structure and function to Huck® pneudraulic fastener installation tools, model numbers 246, 256, 244, 245, or 255 manufactured by Alcoa Fastening Systems. For the sake of brevity, a discussion of each and every component and feature of the fastener installation tool 10 shown in the Figures will not be provided.

Figure 2:
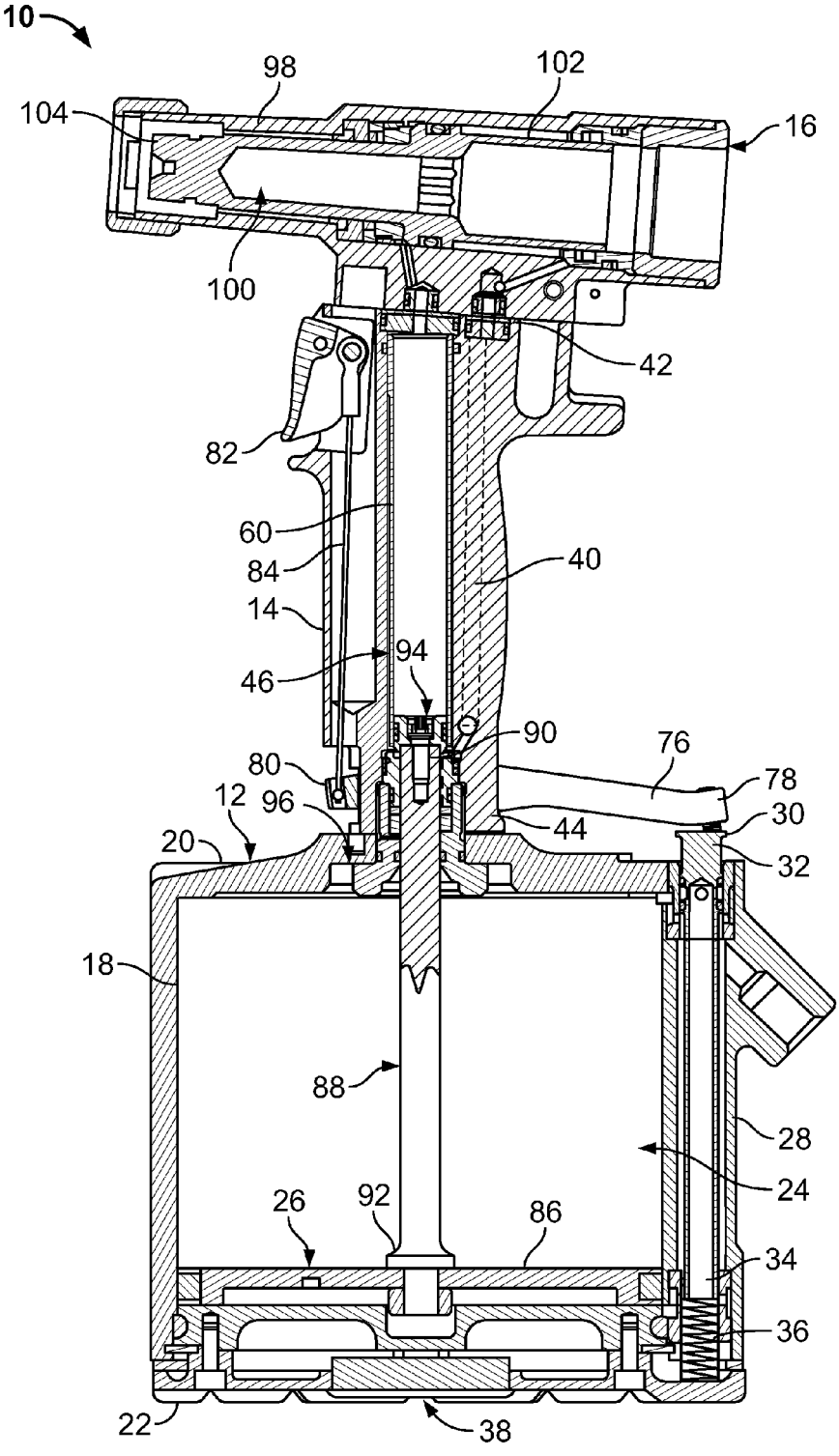
FIG. 2 is a side cross-sectional view, taken along section lines A-A and looking in the direction of the arrows, of the fastener installation tool shown in FIG. 1.

Referring to FIG. 2, in an embodiment, the cylinder assembly 12 includes a housing 18 having an upper end 20 and a lower end 22 opposite the upper end 20, the handle/sleeve assembly 14 being mounted to the upper end 20 of the cylinder assembly 12. In an embodiment, the cylinder assembly 12 includes an interior portion 24 that is sized and shaped to house a pneumatic piston 26 that is movably disposed therein, and which will be described in further detail below. In an embodiment, the cylinder assembly 12 includes an elongated chamber 28 connected fluidly with the interior portion 24 and is sized and shaped to receive slidably a throttle valve 30. The throttle valve 30 includes a first end 32 and a second end 34, and a spring 36 engaged with the second end 34 of the throttle valve 30. In an embodiment, the throttle valve 30 is moveable between a downward pull position and an upward return position, which will be described below. In an embodiment, an air exhaust vent 38 is formed within the lower end 22 of the housing 18.

Figure 3:
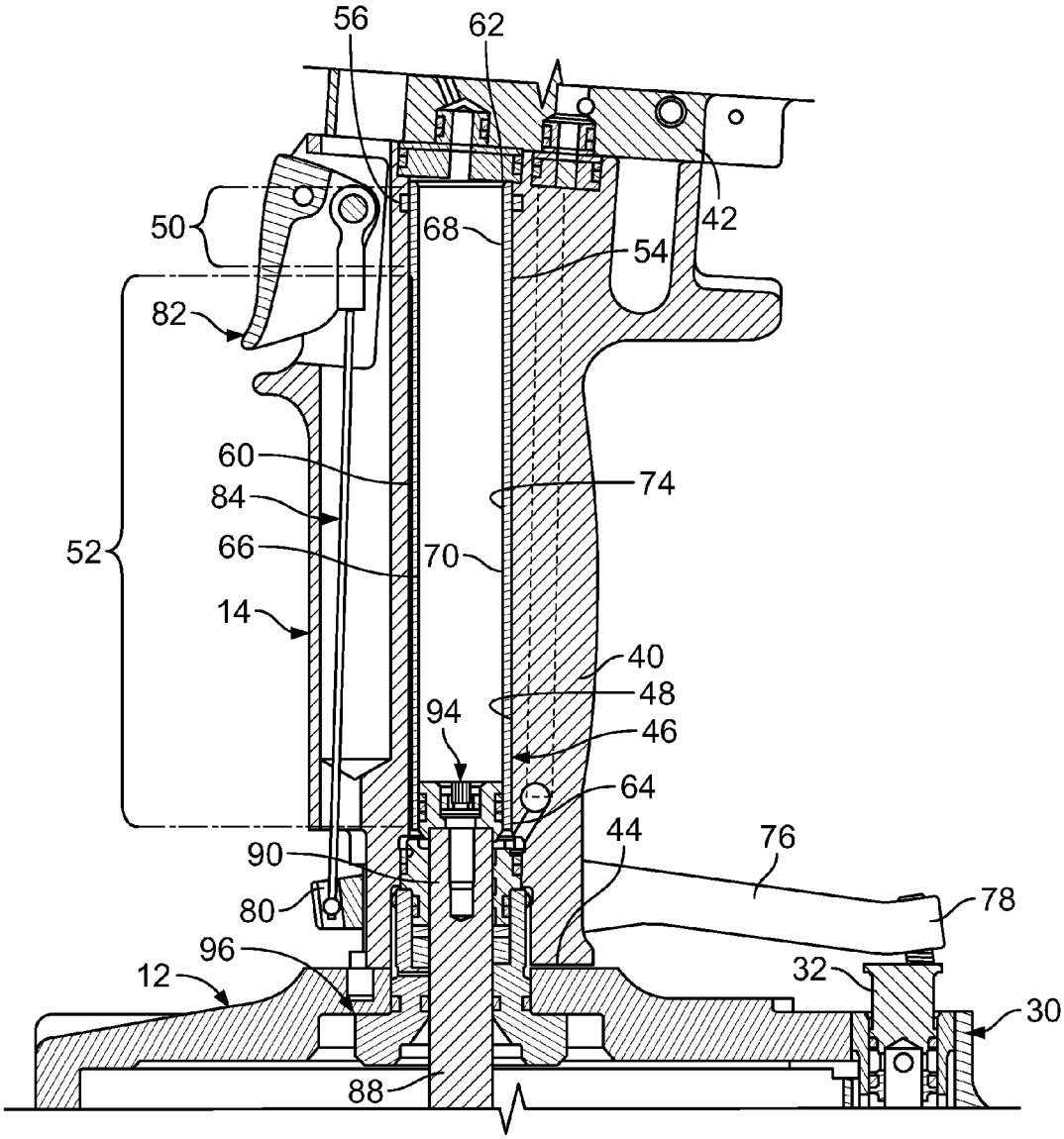
FIG. 3 is an enlarged view of a handle/sleeve assembly employed by the fastener installation tool shown in FIG. 2.
Figure 4:
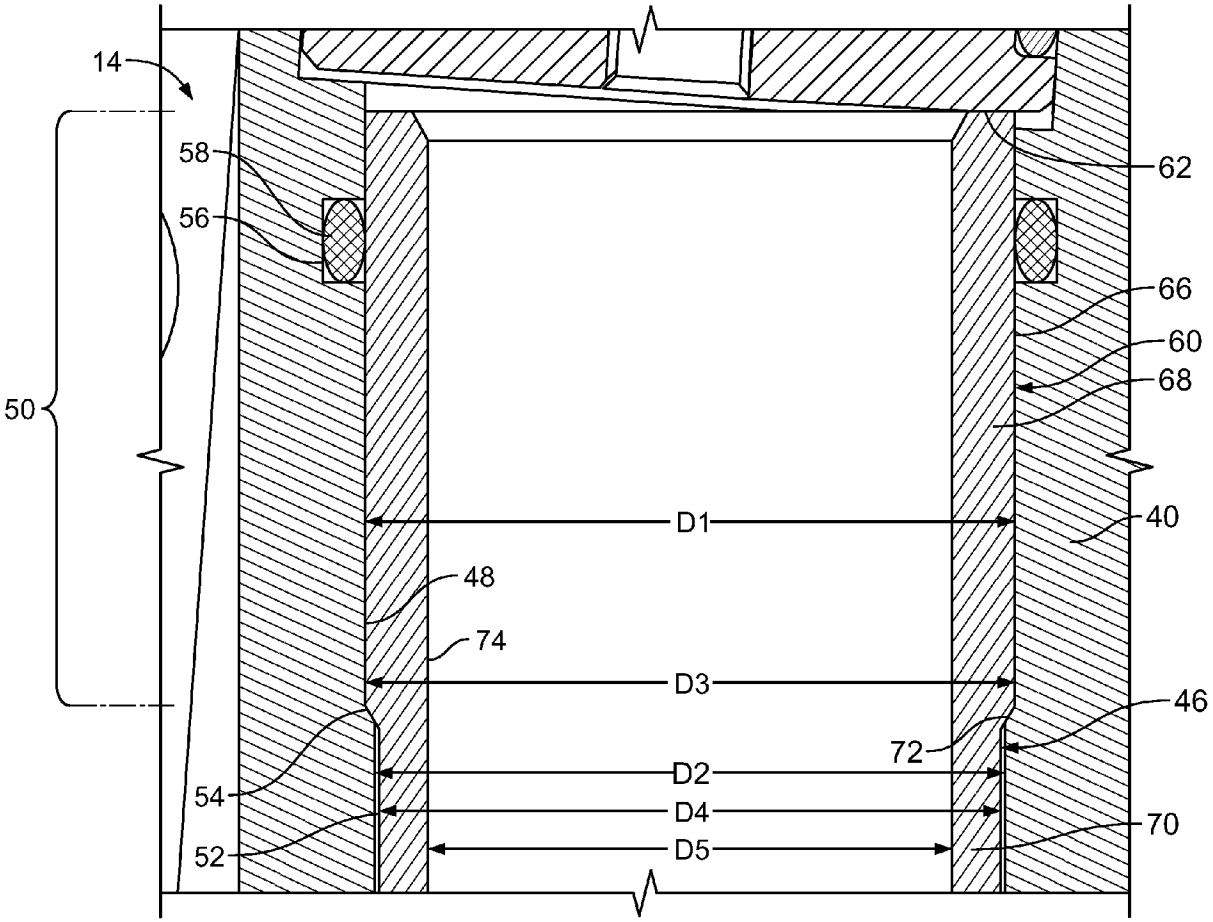
FIG. 4 is another enlarged view of a handle/sleeve assembly employed by the fastener installation tool shown in FIG. 2.

Referring to FIGS. 2 through 4, in an embodiment, the handle/sleeve assembly 14 includes an elongated handle 40 having a first end 42 and a second end 44 opposite the first end 42, and a centrally-located bore 46 that extends from the first end 42 to the second end 44 of the handle 40. With specific reference to FIG. 4, in an embodiment, the bore 46 is substantially cylindrical in shape and forms an inner wall 48 having a first portion 50 with an inner diameter D1 and a second portion 52 with an inner diameter D2. In an embodiment, the inner diameter D1 is greater than the inner diameter D2. In an embodiment, an annular shoulder 54 is formed intermediate the first and second portions 50, 52. In an embodiment, the shoulder 54 extends angularly relative to the inner wall 48. In an embodiment, the shoulder 54 is angled obliquely relative to the inner wall 48. In an embodiment, an annular groove 56 is formed within the handle 40 proximate to the first end 42 thereof and above the shoulder 54. The annular groove 56 is sized and shaped to receive a static O-ring or gasket 58.

With continued reference to FIGS. 2 through 4, in an embodiment, the handle/sleeve assembly 14 includes a tubular sleeve 60 having a first end 62 and a second end 64 opposite the first end 62. With specific reference to FIG. 4, in an embodiment, the sleeve 60 includes an outer wall 66 having a first portion 68 with an outer diameter D3 and a second portion 70 with an outer diameter D4. In an embodiment, the outer diameter D3 is greater than the outer diameter D4. In an embodiment, an annular step 72 is formed intermediate the first and second portions 68, 70. In an embodiment, the step 72 is formed angularly relative to the outer wall 66. In an embodiment, the step 72 is angled obliquely relative to the outer wall 66. In an embodiment, the sleeve 60 includes an inner wall 74 having an inner diameter D5. In an embodiment, the inner diameter D5 is constant through the first and second portions 68, 70 of the sleeve 60. In an embodiment, the inner diameter D5 is constant through the entire length of the sleeve 60.

The sleeve 60 is positioned within the bore 46 of the handle 40 such that the step 72 of the sleeve 60 rests on the shoulder 54 of the handle 40 and the first portion 68 of the sleeve 60 resides within the first portion 50 of the bore 46, while the second portion 70 of the sleeve 60 resides within the second portion 52 of the bore 46. In an embodiment, the O-ring 58 fits around the outer wall 66 of the sleeve 60 at a location proximate to the first end 62 thereof and traps the sleeve 60 within the bore 46 proximate to the first end 42 of the handle 40. In an embodiment, the O-ring 58 is fitted around the outer wall 66 of the sleeve 60 at approximately one inch below the first end 62 thereof. In an embodiment, from below the shoulder 54 of the handle 50 and the step 72 of the sleeve 60 and extending to the second end 64 of the sleeve 60, there exists a clearance fit (i.e., space) between the outer wall 66 of the sleeve 60 and the second portion 52 of the inner wall 48 of the bore 46 of the handle 40. In an embodiment, the clearance fit is approximately 0.005 inch.

Referring to FIGS. 2 and 3, the tool 10 includes a throttle arm 76 having a first end 78 and a second end 80, with the first end 78 being attached to the first end 32 of the throttle valve 30. A trigger (i.e., throttle lever) 82 is mounted to the handle 40 and is connected to the second end 80 of the throttle arm 76 by a cable assembly 84.

Still referring to FIGS. 2 and 3, the piston 26 includes a piston head 86 and a piston rod 88 extending therefrom and having a first end 90 and a second end 92. The first end 90 of the piston rod 88 is inserted slidably within the second end 64 of the sleeve 60, while the second end 92 of the piston rod 88 is attached to the piston head 86. In an embodiment, a piston assembly 94 is provided on the first end 90 of the piston rod 88. In an embodiment, the piston rod 88 engages a gland assembly 96 positioned between the cylinder assembly 12 and the handle/sleeve assembly 14.

Referring to FIG. 2, in an embodiment, the tool head 16 includes a housing 98 having an interior portion 100. Housed within the interior portion 100 is a pull piston 102 and a nose assembly 104 attached thereto. In an embodiment, the pull piston 102 and the nose assembly 104 are moveable between a forward home position and a backward engaged position, which will be described in further detail below. In an embodiment, the nose assembly 104 includes a collet and an anvil that are adapted to engage and install a fastener (not identified in the Figures).

In an embodiment, the housing 18 of the cylinder assembly 12, the handle 40 of the handle/sleeve assembly 14, and the housing 98 of the tool head 16 are each made of aluminum, while the sleeve 60 is made from steel. In other embodiments, each of the foregoing components may be made from other suitable materials known within the fastener installation tool art.

In an embodiment, when the trigger 82 is depressed, the throttle valve 30 moves to a downward position, and pressurized air is directed to the bottom of the piston head 86, causing it to move upward. The air above the piston head 86 is exhausted and directed through the center of the throttle valve 30 and out the exhaust vent 38 of the housing 18 of the cylinder assembly 12. When the piston rod 88 moves upward, a column of pressurized hydraulic fluid is forced up into the tool head 16, which moves the pull piston 102 to its backward engaged position. In turn, the nose assembly 104 moves along with the pull piston 102 to the backward engaged position in order to commence fastener installation.

When fastener installation is completed, the trigger 82 is released, and air pressure, with the assistance of the spring 36, causes the throttle valve 30 to return to its upward position. Pressurized air is re-directed to the top of the piston head 86, causing it, along with the piston rod 88, to move downwardly. The air from below the piston head 86 is exhausted through the vent 38. As this occurs, hydraulic pressure is reversed and the pull piston 102 and nose assembly 104 are returned to their forward home position.

As indicated above, there exists a clearance fit (i.e., space) between the outer wall 66 of the sleeve 60 and the second portion 52 of the inner wall 48 of the bore 46 of the handle 40, while there is a close, tight fit between the outer wall 66 of the sleeve 60 and the first portion 50 of the inner wall 48 of the bore 46, facilitated by the O-ring 58. As a result, the sleeve 60 is adapted to flex laterally within the bore 46 of the handle 40 during operation of the tool 10. In an embodiment, the sleeve 60 can flex in a direction F as shown in FIG. 3, but it is understood that the sleeve 60 can flex laterally in any direction relative to the circumference of the bore 46. The aforesaid clearance fit allows for a much more forgiving alignment of the piston assembly 94 within the bore 46. In addition, a close, concentric fit between the sleeve 60 and the bore 46 is assured without relying on extreme tolerances to achieve same.

In addition, the clearance fit between the sleeve 60 and the bore 46 of the handle 40 also allows for the introduction of a volume of hydraulic fluid (e.g., oil) between the outer wall 66 of the sleeve 60 and the inner wall 48 of the bore 46, which provides a cushion to absorb excess oil displacement.

Also, during the down stroke (i.e., return) pressure cycle of the tool 10, the existence of the hydraulic fluid between the sleeve 60 and the bore 46 ensures hydrostatic balance between the inner and outer walls 66, 74 of the sleeve 60, thereby preventing radial expansion of the sleeve 60, and further ensures a smaller extrusion gap at the interface between the seal containment components. As a result, leakage of hydraulic fluid from the handle 40 is prevented, the tool 10 cycles faster during operation due to lower running friction, and the lives of the sleeve 60 and the piston 26 and piston seals are increased. Moreover, the sleeve 60 is fully replaceable without the need to replace the handle 40.

It should be understood that the embodiments described herein are merely exemplary and that a person skilled in the art may make many variations and modifications without departing from the spirit and scope of the invention. All such variations and modifications are intended to be included within the scope of the invention as defined in the appended claims.

What is claimed is:

1. A fastener installation tool, comprising:

a cylinder assembly including a housing having an upper end, a lower end opposite the upper end; and a handle/sleeve assembly including a handle attached to the upper end of the cylinder assembly, the handle having a first end, a second end opposite the first end, a bore extending between the first and second ends, and an inner wall defined by the bore, the inner wall having a first portion with a first inner diameter, a second portion with a second inner diameter, and an annular shoulder intermediate the first and second portions, the first inner diameter of the first portion being greater than the second inner diameter of the second portion, the handle/sleeve assembly further including a sleeve having a first end, a second end opposite the first end of the sleeve, an outer wall having a first portion with a first outer diameter and a second portion with a second outer diameter, and an annular step formed intermediate the first and second portions of the outer wall of the sleeve, the first portion of the sleeve extending from the first end of the sleeve to the annular step and the second portion of the sleeve extending from the annular step to the second end of the sleeve, the first outer diameter of the first portion of the outer wall of the sleeve being greater than the second outer diameter of the second portion of the outer wall of the sleeve, wherein the sleeve is positioned within the bore of the handle such that the annular step of the sleeve engages the annular shoulder of the inner wall of the handle, and the first portion of the outer wall of the sleeve is juxtaposed with the first portion of the inner wall of the handle, while the second portion of the outer wall of the sleeve is juxtaposed with the second portion of the inner wall of the handle, and such that an annular space is formed between the second portion of the outer wall of the sleeve and the second portion of the inner wall of the handle from below the annular shoulder of the inner wall of the handle and the annular step of the outer wall of the sleeve and extending to the second end of the sleeve, wherein the sleeve is adapted to flex laterally within the bore of the handle during operation of the fastener installation tool.

2. The fastener installation tool of claim 1, wherein the space is adapted to receive a volume of hydraulic fluid.

3. The fastener installation tool of claim 1, wherein the annular step is formed angularly relative to the outer wall.

4. The fastener installation tool of claim 1, wherein the annular step is angled obliquely relative to the outer wall.

5. The fastener installation tool of claim 1, further comprising an O-ring fitted around the outer wall of the sleeve, and wherein the inner wall of the first portion of the handle includes an annular groove that is sized and shaped to house the O-ring.

6. The fastener installation tool of claim 5, wherein the O-ring fits around the outer wall of the sleeve at a location proximate to a first end thereof.

7. The fastener installation tool of claim 1, wherein the sleeve is adapted to flex laterally in any direction relative to a circumference of the bore of the handle.

8. The fastener installation tool of claim 1, wherein the cylinder assembly includes a piston having a piston head and a piston rod extending from the piston head, wherein the piston rod is received slidably within the sleeve.

9. The fastener installation tool of claim 1, wherein the tubular sleeve includes an inner wall having an inner diameter that is constant throughout the first and second portions of the sleeve.

10. The fastener installation tool of claim 1, further comprising a tool head attached to the first end of the handle.

11. The fastener installation tool of claim 10, wherein the tool head includes a pull piston and a nose assembly having a collet and an anvil.

* * * * *